US006878893B2

(12) United States Patent
Tanaka et al.

(10) Patent No.: US 6,878,893 B2
(45) Date of Patent: Apr. 12, 2005

(54) TACTILE SWITCH

(75) Inventors: Toshiyuki Tanaka, Fukuoka (JP); Kazunori Hamasaki, Fukuoka (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 10/107,061

(22) Filed: Mar. 28, 2002

(65) Prior Publication Data

US 2003/0183496 A1 Oct. 2, 2003

(51) Int. Cl.[7] ..... H01H 5/18
(52) U.S. Cl. ..... 200/406; 200/405; 200/520; 200/341; 200/512; 200/516
(58) Field of Search ..... 200/406, 405, 200/520, 341, 512, 516

(56) References Cited

U.S. PATENT DOCUMENTS 5,389,757 A * 2/1995 Souliere ..... 200/345
5,967,297 A * 10/1999 Kaufman et al. ..... 200/241
6,271,491 B1 * 8/2001 Ono et al. ..... 200/520
6,489,580 B2 * 12/2002 Yanai et al. ..... 200/406

OTHER PUBLICATIONS

Japanese Office Action dated Mar. 26, 2002.

* cited by examiner

*Primary Examiner*—Lincoln Donovan
*Assistant Examiner*—Jennifer A. Poker
(74) *Attorney, Agent, or Firm*—Whitham, Curtis & Christofferson, PC

(57) ABSTRACT

A first stationary contact is provided on the base body. A second stationary contact is provided on the base body. A conductive click spring is disposed over the first stationary contact and the second stationary contact, so as to be always electrically connected to the first stationary contact and so as to be away from the second stationary contact in a neutral position thereof. A push button includes a head portion which is depressed by an operator, and an actuator which pushes the click spring so as to be abutted against the second stationary contact when the head portion is depressed. The head portion and the actuator is integrally formed from rubber having elastic restorability.

3 Claims, 2 Drawing Sheets

TACTILE SWITCH

BACKGROUND OF THE INVENTION

The present invention relates to a tactile switch and, more particularly, to a tactile switch enabled to increase the lifetime of a product, such as a click spring provided therein.

Such a kind of a related tactile switch is described hereinbelow with reference to FIG. 4.

As shown in this figure, a concave portion 3 is provided in a base 2 of a tactile switch 1. Stationary contacts 5 and 6 are disposed on the bottom face 4 of the concave portion 3. Terminals 7 and 8 to be fixed to a circuit board 9 are connected to the stationary contacts 5 and 6.

On the other hand, a circular click spring 10 is disposed over the top faces (that is, the right-hand-side faces, as viewed in this figure) of the stationary contacts 5 and 6 fixed onto the bottom face 4 of the concave portion 3. A circumferential portion of the click spring 10 is connected to the stationary contact 6. The central portion of the click spring 10 is formed in such a way as to be able to move upwardly and downwardly.

Thus, the central portion of the click spring 10 is provided in such a manner as to be always away from the stationary contact 5 disposed at the center of the bottom face 4 of the concave portion 3. Furthermore, a push button 11 is formed above the click spring 10 (at the right-hand side thereof, as viewed in this figure) in such a way as to be able to move freely upwardly and downwardly with respect to the bottom face 4 of the concave portion 3.

Further, the push button 11 is installed in such a manner as to be restrained by a cover 12 from moving sideways. Furthermore, an actuator 13 is provided on the bottom face of the push button 11. The actuator 13 and the push button 11 are formed from a synthetic resin.

When the push button 11 is depressed, the central portion of the click spring 10 is pushed through the actuator 13 so that the central portion of the click spring 10 descends toward the bottom face 4 of the concave portion 3 (that is, to the left-hand side thereof) and comes into contact with the stationary contact 5. Therefore, the stationary contacts 5 and 6 are electrically conducted to each other. Thus, the tactile switch 1 performs a switching operation.

However, since the push button and the actuator are formed from a synthetic resin having low elasticity, the pushing operation of the push button tends to give an excessive impact to the click spring. This causes decrease in the lifetime of the click spring and deterioration in the quality thereof.

SUMMARY OF THE INVENTION

It is therefore an object of the present invention to provide a tactile switch enabled to increase the lifetime of the click spring and as to prevent the deterioration in the quality thereof.

In order to achieve the above object, according to the present invention, there is provided a tactile switch, comprising:

a base body;

a first stationary contact, provided on the base body;

a second stationary contact, provided on the base body;

a conductive click spring, disposed over the first stationary contact and the second stationary contact, so as to be always electrically connected to the first stationary contact and so as to be away from the second stationary contact in a neutral position thereof;

a push button, including a head portion which is depressed by an operator, and an actuator which pushes the click spring so as to be abutted against the second stationary contact when the head portion is depressed, wherein the head portion and the actuator is integrally formed from rubber having elastic restorability.

In this tactile switch, since the head portion and the actuator of the push button for pushing the click spring are formed from rubber having elasticity, an excessive impact caused by pushing operation can be absorbed by the push button itself.

Therefore, the click spring is prevented from undergoing an excessive impact so that the lifetime of the click spring is increased. Moreover, deterioration in the quality thereof is prevented. Furthermore, because the head portion and the actuator are formed from rubber, the pushing stroke of the tactile switch is increased. Thus, a switching operation of the tactile switch can reliably be performed.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Hereinafter, preferred embodiments of the invention are described with reference to the accompanying drawings.

Figure 1:
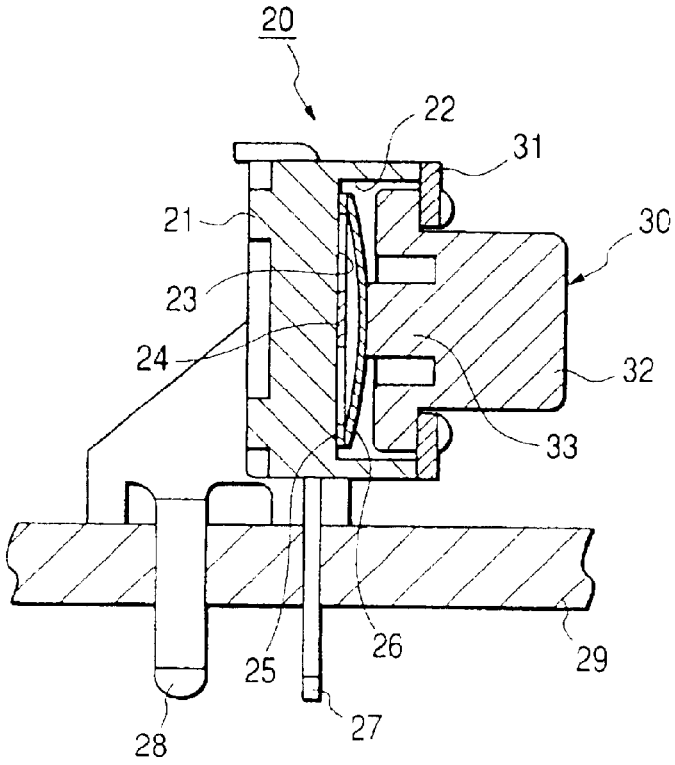
FIG. 1 is a longitudinal section view illustrating a tactile switch according to a first embodiment of the invention.

Incidentally, for convenience of description, the embodiment of the invention is described hereinbelow by regarding lateral directions viewed in FIGS. 1 and 2 as upward and downward directions with reference to the bottom face 23 of the concave portion 22.

These figures show a first embodiment of the invention. A concave portion 22 is formed in a base 21 of a tactile switch 20. Stationary contacts 24 and 25 are disposed on the central portion and the circumferential portion of the bottom face 23 of the concave portion 22, respectively. A circular click spring 26 is disposed over the top faces of the stationary contacts 24 and 25.

Further, an outer edge portion of the click spring 26 is formed in such a way as to be always in contact with the stationary contact 25 disposed on the circumferential portion of the bottom face 23 of the concave portion 22. On the other hand, the central portion of the click spring 26 is formed in such a manner as to be able to move upwardly and downwardly. The central portion of the click spring 26 and the stationary contact 24 disposed at the center of the bottom face 23 of the concave portion 22 are provided in such a manner as to be always apart from each other.

Furthermore, the stationary contact 24 is connected to a terminal 27, while the stationary contact 25 is connected to a terminal 28. The terminals 27 and 28 are fixed to a circuit board 29. Moreover, a push button 30 is disposed above the click spring 26 (that is, at the right-hand side thereof, as viewed in these figures) so as to be movable upwardly and downwardly.

The push button 30 is attached to the base 21 in such a way as to be restrained by a cover 31 from laterally swinging. Further, the push button 30 is formed so that a head portion 32 of the push button 30 is exposed from an opening portion provided in the cover 31, and that a switching operation can then be performed by pushing the head portion 32.

Furthermore, an actuator 33 is integrally provided on the bottom face of the head portion 32 of the push button 30. The bottom part (that is, the left-end part) of the actuator 33 is constructed in such a fashion as to abut against the central top portion of the click spring 26. The push button 30 and the actuator 33 are integrally formed from rubber having elastic restorability.

Figure 2:
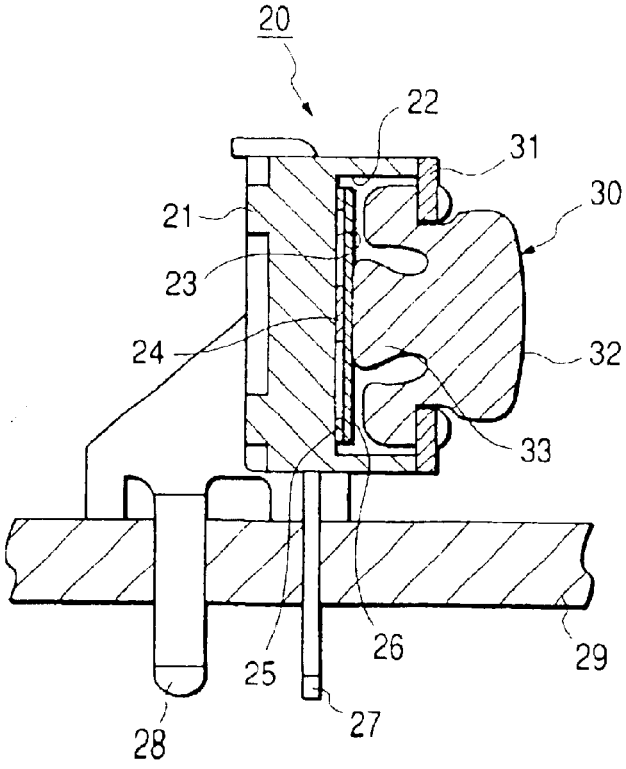
FIG. 2 is a longitudinal section view illustrating a state that a push button of the tactile switch of FIG. 1 is depressed.

Thus, when the push button 30 of the tactile switch 20 is depressed, the actuator 33 linking with the push button 30 pushes the central top portion of the click spring 26, so that the central portion of the click spring 26 comes into contact with the stationary contact 24 disposed at the center of the bottom face 23 of the concave portion 22 of the base 21, as illustrated in FIG. 2.

At this time, since the push button 30 and the actuator 33 are formed from rubber having elastic restorability, an excessive impact is absorbed by the push button 30 and the actuator 33. Consequently, the click spring 26 is prevented from undergoing the impact.

Further, because the push button 30 and the actuator 33 are formed from the rubber, the pushing stroke of the tactile switch 20 can be increased. Therefore, as compared with the related tactile switch that is short in stroke and requires delicate adjustment thereof, the invention facilitates the adjustment of the pushing stroke of the tactile switch 20. Consequently, a switching operation of the tactile switch 20 can reliably be performed. The pushing stroke of the tactile switch 20 can easily be set by properly adjusting the diameter and length of the actuator 33.

Figure 3:
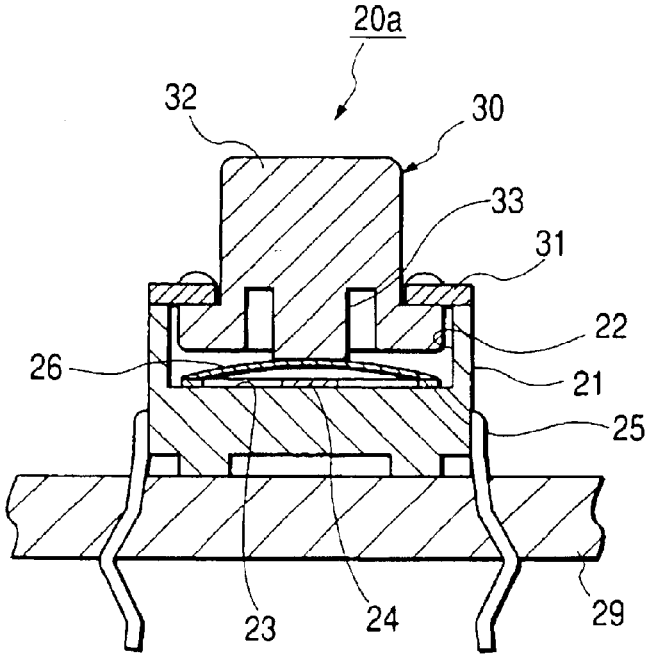
FIG. 3 is a longitudinal section view illustrating a tactile switch according to a second embodiment of the invention.
Figure 4:
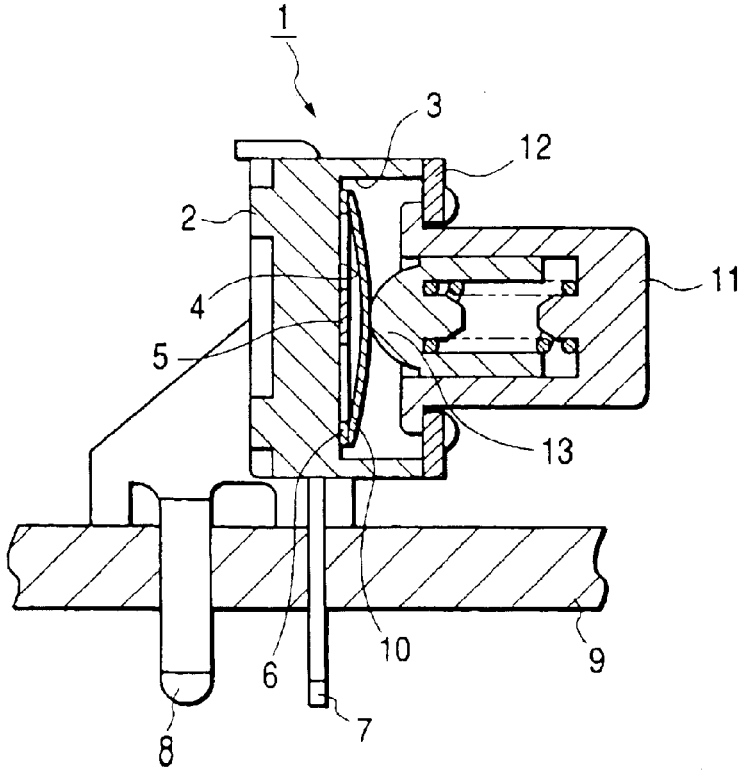
FIG. 4 (Related Art)
FIG. 4 is a longitudinal section view illustrating a related tactile switch.

FIG. 3 shows a vertical type tactile switch 20*a*, which is a second embodiment of the invention. The aforementioned configuration and operation can be applied to such a vertical type tactile switch 20*a*.

Incidentally, various changes and modifications may be made without departing from the spirit of the invention. Further, needless to say, the invention covers the changes and modifications.

What is claimed is:

1. A tactile switch, comprising:

a base body;

a first stationary contact, provided on the base body;

a second stationary contact, provided on the base body;

a conductive click spring, disposed over the first stationary contact and the second stationary contact, so as to be always electrically connected to the first stationary contact and so as to be away from the second stationary contact in a neutral position thereof;

a push button, including an elastically deformable head portion which is depressed by an operator, and an elastically deformable actuator which directly pushes the click spring against the second stationary contact when the head portion is depressed, wherein the head portion and the actuator are integrally formed from rubber having elastic restorability;

wherein the base body is formed with an opening from which the push button is exposed; and wherein the head portion is deformable so as to have a larger width than a width of the opening, so that a region of the push button between the head portion and the actuator is deformable to contact an inner edge of the opening when the head portion is depressed.

2. The tactile switch as set forth in claim 1, wherein the base body includes a cover body having an aperture from which the head portion of the push button is exposed while being prevented from moving in a lateral direction.

3. The tactile switch as set forth in claim 1, wherein the head portion is directly depressed by the operator.

* * * * *